US007052297B2

(12) United States Patent
Panzar et al.

(10) Patent No.: US 7,052,297 B2
(45) Date of Patent: May 30, 2006

(54) ROTARY CONNECTOR HAVING REMOVABLE AND REPLACEABLE CONTACTS

(75) Inventors: Mario Panzar, Houston, TX (US); Alan L. Carmichael, Houston, TX (US)

(73) Assignee: Wireline Technologies, Inc., Houston, TX (US)

( * ) Notice: Subject to any disclaimer, the term of this patent is extended or adjusted under 35 U.S.C. 154(b) by 0 days.

(21) Appl. No.: 10/925,672

(22) Filed: Aug. 25, 2004

(65) Prior Publication Data

US 2006/0051996 A1 Mar. 9, 2006

(51) Int. Cl.
*H01R 29/00* (2006.01)
*H01R 11/18* (2006.01)
*H01R 13/00* (2006.01)

(52) U.S. Cl. ..... 439/169; 439/482

(58) Field of Classification Search ..... 439/169, 439/482

See application file for complete search history.

(56) References Cited

U.S. PATENT DOCUMENTS 5,389,003 A 2/1995 Van Steenwyk et al.
5,468,153 A 11/1995 Brown
5,820,416 A 10/1998 Carmichael
5,927,402 A 7/1999 Benson et al.
5,967,816 A 10/1999 Sampa et al.
6,439,932 B1 8/2002 Ripolone
6,755,694 B1 * 6/2004 Ries et al. ..... 439/668
6,854,994 B1 * 2/2005 Stein et al. ..... 439/218
6,921,295 B1 * 7/2005 Sommer et al. ..... 439/668

* cited by examiner

*Primary Examiner*—Chandrika Prasad
(74) *Attorney, Agent, or Firm*—Keeling Patents & Trademarks; Kenneth A. Keeling

(57) ABSTRACT

A connector that includes a male connector assembly having a nose portion that removably fits within an axial cavity in a female connector assembly and which has removable, replaceable contacts. The connector assemblies are constructed for attachment to equipment and instrumentation in wet or dry environments. Each connector assembly may include a plurality of conductors that are constructed for attachment to conductors in the equipment and instrumentation. Each conductor in the male connector assembly is matched with a conductor in the female connector assembly for transmission of a signal therethrough. Electrical contacts within the connector assemblies provide individual contact of the matching conductors. Insulators separate and insulate the electrical contacts from one another.

10 Claims, 4 Drawing Sheets

ROTARY CONNECTOR HAVING REMOVABLE AND REPLACEABLE CONTACTS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to contacts for rotary connectors. Specifically, this invention relates to removable and replaceable contacts for electrical connectors.

2. Description of the Related Art

Connector systems that either maintain electrical continuity while a first connector member may be rotatable with respect to a second connector member or allow for rotation while engaging or disengaging of connector members are useful in down hole assembly applications. In operation it is known a circular contact may be employed about or within a connector member to contact a mating member having a non-circular contact. Non-circular contacts may be conducting surfaces coaxial to the connector members inner diameter or surfaces creating a depression coaxial to the mating member.

Prior art connectors often use a circular contact around the outer surface of the male connector rod or probe and a circular contact around the interior surface of the receiver or female connector to transfer a signal through the connector. An example of such a contact is U.S. Pat. No. 5,389,003 issued to Van Steenwyk et al. on Feb. 14, 1995, which discloses a wireline wet connection between receivers and probes. A conducting ring consists of a bow spring element wrapped about a conductive cylinder and bowed outwardly to make positive pressure electrical contact with a contact ring embedded in the insulative body, and a conductive inner spring element captive within the inner diameter of the receiver.

U.S. Pat. No. 5,468,153 issued to Brown et al. on Nov. 21, 1995, discloses a rotatable electrical connector. A mandrel includes an enlarged hollow cylindrical head with circumferential grooves into which beryllium copper wiper springs are mounted so as to contact the interior of the housing. A brass head also has two circumferential grooves into which beryllium copper wiper springs are mounted. Continuous electric contact on the "hot wire" of the wireline is maintained between a rotor and stator through the beryllium copper wiper springs which continuously provide approximately 100 or more electrical contact points between the mating surfaces. Continuous electric contact of the "ground" is similarly maintained between the head of the mandrel and the upper housing by the beryllium copper wiper springs.

U.S. Pat. No. 5,820,416 issued to Carmichael on Oct. 13, 1998, discloses a multiple contact wet connector that includes a probe assembly having a nose portion that removably fits within an axial cavity in a receiver assembly. The receiver is constructed to hold and maintain the relative longitudinal position of a circular spring contact. In an alternative embodiment, the circular spring contacts are affixed on three sides in the probe electrical contact which extends to the surface of the probe. Use of a circular spring in such a channel on a surface-exposed contact as either the receiver or probe contact are taught in claims 12 and 13 therein, respectively.

U.S. Pat. No. 5,927,402 issued to Benson et al. on Jul. 27, 1999 and U.S. Pat. No. 5,967,816 issued to Sampa et al. on Oct. 19, 1999, disclose a receiver assembly having a series of receiver contacts disposed about a common axis. Each contact is machined from a single piece of electrically conductive material and has a sleeve portion with eight extending fingers. The fingers are shaped to bow radially inward, in other words to have, from sleeve portion to a distal end, a first portion that extends radially inward and a second portion that extends radially outward, forming a radially innermost portion with a contact length of about 0.150 inch. By machining contact from a single piece of stock, fingers, in their relaxed state as shown, have no residual bending stresses that tend to reduce their fatigue resistance.

U.S. Pat. No. 6,439,932 issued to Ripolone on Aug. 27, 2002, discloses a multiple contact connector having a receiver and a probe. The receiver has conductor rings, or contact rings embedded in the inner surface of an insulator at predetermined unique axial spacings. The probe has contact rings embedded within its outer surface corresponding axially to the receptacle contact rings.

Contacts on connecting members typically wear over time due to repeated use and may be damaged due to external objects such as impacts to the contact when exposed or due to foreign objects in or on the mating member when impact or become embedded in the connector. In such circumstances the contact may become damaged so as to no longer function. In operation such prior art has required widespread disassembly of one connecting member to replace worn contacts, which are typically embedded or integral to the connecting member. As a result, when such contacts become worn the connecting member may not be usable for some time.

BRIEF SUMMARY OF THE INVENTION

Accordingly, it is an object of the present invention to provide an electrical contact that is replaceable.

It is another object of the present invention to provide an electrical contact that may be easily and quickly replaced in the field without need for extensive disassembly.

It is another object of the present invention to provide at least one electrical contact over the smallest possible distance.

Other features and advantages of the invention will be apparent from the following description, the accompanying drawing and the appended claims.

DESCRIPTION OF HE INVENTION

Figure 1:
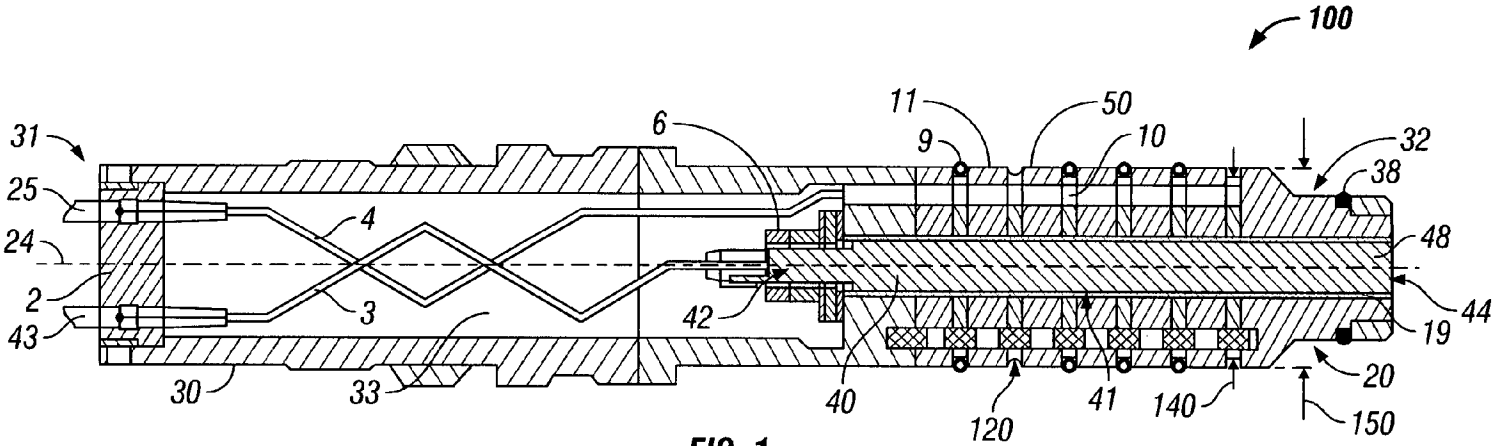
FIG. 1 is a cross sectional view of the preferred embodiment of a probe of the rotary connector having replaceable electrical contacts, together with the alternative o-ring.
Figure 2:
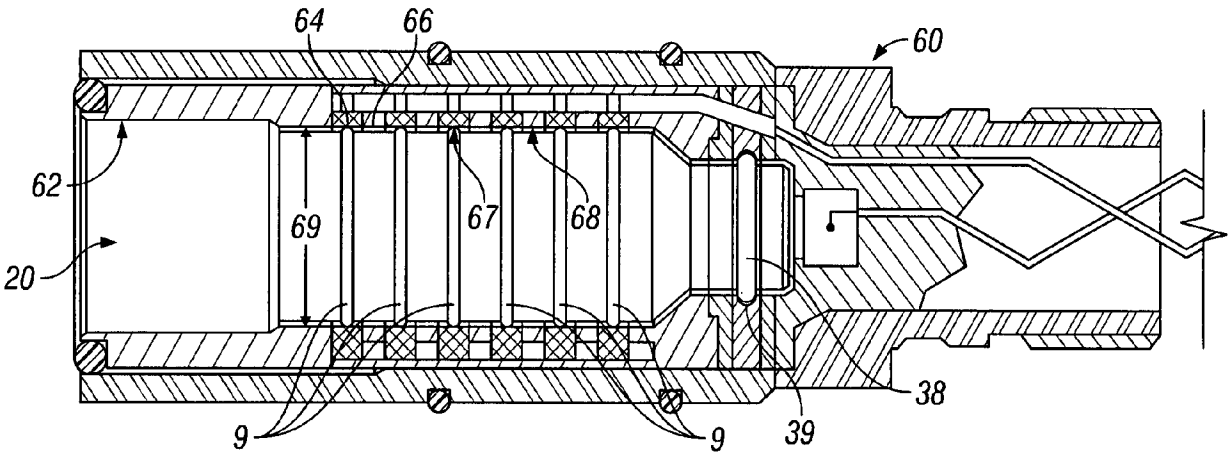
FIG. 2 is a cross sectional view of the preferred embodiment of a receiver of a rotary connector, having received the probe therein, together with the alternative o-ring receiving location.

Referring to FIG. 1, the probe 20 of a rotary connector 100 having multiple replaceable contacts 9 is depicted. Replaceable contacts 9 are located about probe 20. When rotary connector 100 is assembled, probe 20 fits snugly within receiver 60 (FIG. 2).

Probe 20 includes a generally cylindrical body 30, a connector rod 40, an insulating sleeve 19, and one or more subsurface conductor rings 10 and insulator rings 11. Body 30 has a body first end 31, a body second end 32 and a body opening 33 through the length of body 30. Body 30 is generally cylindrical about a probe axis 24.

Connector rod 40 is also cylindrical in shape and has a connector rod outer surface 41 around which insulating sleeve 19 is located. Connector rod 40 has a nose 48 on a connector rod second end 44. Connector rod 40 and insulating sleeve 19 are retained at a connector rod first end 42 within body second end 32. Connector rod 40 and insulating sleeve 19 extend outward from body 30 and axially coalign with probe axis 24.

A contact block assembly 2 is retained within body first end 31. Contact block assembly 2 retains at least one pin connector 25. Each pin connector 25 is attached to a corresponding wire 4, each of which provides electrical continuity between a pin connector 25 and a corresponding conductor ring 10. A ground wire 3 provides electrical continuity between a ground pin connector 43 and connector rod 40. Wires 3 and ground wire 4 extend from pin connectors 25 and ground pin connector 43, respectively, through body opening 33.

Conductor rings 10 and insulator rings 11 are alternately located along the outer surface of insulating sleeve 19 extending from body second end 32. Conductor rings 10 have a conductor outer diameter 140. Insulator rings 11 have an insulator outer diameter 150. Conductor ring outer diameter 140 is less than insulator outer diameter 150. A replaceable contact 9 is located about each conductor ring 10. Because insulator outer diameter 150 is larger than conductor outer diameter 140, replaceable contact 9 is retained between insulator rings 11 and no portion of conductor rings 10 extend to the surface of cylindrical body 30.

Figure 3A:
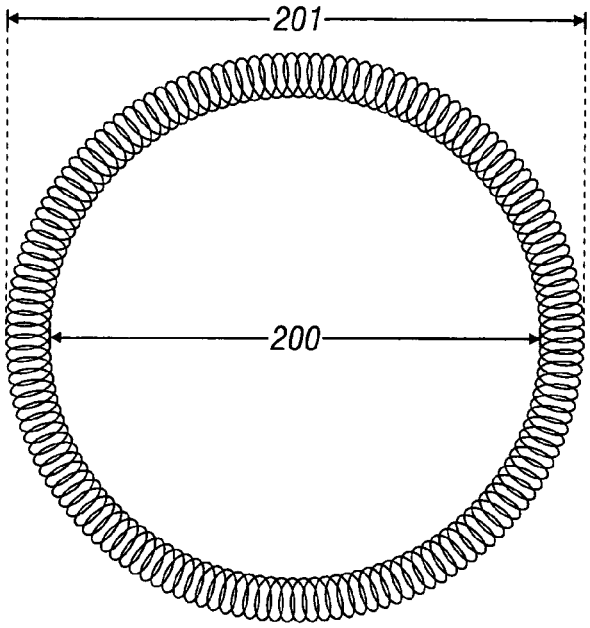
FIG. 3*a* is a front view of a first embodiment of a replaceable electrical contact in a relaxed position.
Figure 3B:
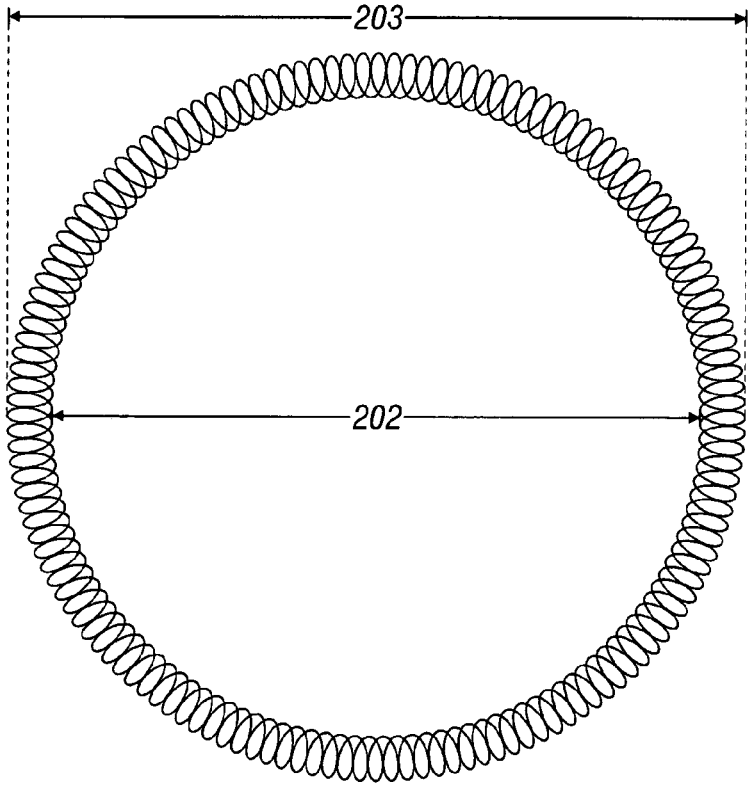
FIG. 3*b* is a front view of the first embodiment of a replaceable electrical contact in an expanded position.

Referring to FIGS. 3*a* and 3*b*, when replaceable contact 9 is viewed separately from probe 20, it can be seen that replaceable contact 9 is circular in shape, having a relaxed contact inner diameter 200 and a relaxed contact outer diameter 201. Replaceable contact 9 is elastic, thereby providing an extended contact inner diameter 202, which is larger than relaxed contact inner diameter 200. The elasticity of replaceable contact 9 biases contact 9 toward a relaxed position. Thus, when placed over conductor ring 10, replaceable contact 9 contracts towards relaxed position, although it is held in an extended position in which the biasing force creates constant contact between replaceable contact 9 and conductor ring 10.

When positioned around conductor ring 10, extended contact outer diameter 203 is larger than insulator outer diameter 150. Thus, when assembled, replaceable contacts 9 are raised above insulator rings 11 to provide electrical contact with receiver conductor rings 64 on receiver 60.

Replaceable contacts 9 may be canted springs. Canted spring 9 is made of a conductive metal. The diameter of canted spring 9 is greater than the distance between insulator ring 11 and conductor ring 10, respectively.

At least one replaceable contact 9 is spaced along connector rod 40. An insulator ring 11 is located between each contact 9 and serves to retain each contact 9 in a predetermined location. Insulator rings 11 and conductor rings 10 are alternately located over insulating sleeve 19 extending away from connector rod 40.

The outer diameter 150 of each insulator ring 11 is larger than the outer diameter 140 of each conductor ring 10. Thus, a recess 50 is defined around each conductor ring 10 between adjacent insulator rings 11, respectively. A replaceable contact 9 is placed within each recess 50. While conductor ring 10 may be wider than replaceable contact 9 and wider than recess 50, no portion of conductor ring 10 may have an outer diameter 140 equal to or greater than insulator outer diameter 150. Such additional subsurface width of conductor ring 10 may thereby provide lateral contact with removable contact 9 in a shoulder or groove 120 such that conductor ring 10 has a concave outer shape. Conductor ring 10 must be less than insulator outer diameter 150 to limit the conducting surface area and thereby increase the number of contacts locatable along probe 20.

Referring to FIG. 2, receiver 60 is depicted with probe 20. Receiver 60 includes a cylindrical housing 62 within which conductor rings 64 and insulator rings 66 are alternately spaced. Insulator rings 66 and conductor rings 64 have an equivalent insulator interior diameter 69, thereby making conductor ring inner surface 67 flush with insulator ring inner surface 68. Insulator rings 66 and conductor rings 64 are constructed to respectively be proximate to conductor ring 10 between adjacent insulator rings 11, respectively. Interior diameter 69 of receiver 60 is greater than insulator outer diameter 150 but not greater than the combined diameter of conductor ring outer diameter 140 and the diameter of replaceable contact 9. As a result of such difference, in operation replaceable contact 9 is compressed between conductor ring 10 and conductor ring 64 such that at least one point of contact exists between replaceable contact 9 and conductor ring 10 and at least one point of contact exists between replaceable contact 9 and conductor 64, thereby completing the circuit. As a result of such points of contact, should probe 20 rotate along its connector axis with respect to receiver 60, at least one point of contact will continue to exist.

By selecting a replaceable contact 9 with a spring force coefficient sufficient to retain it about probe 20 but also sufficient to permit removal when desired, replacement of worn contacts, namely removable contract 10, is permitted without necessity of disassembly of probe 20. Moreover removable contact 9 may be inspected for replacement merely by removal of probe 20 from receiver 60.

Figure 3C:
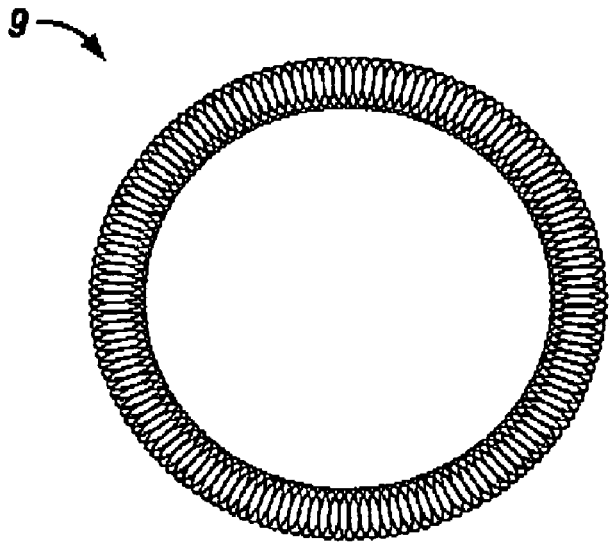
FIG. 3*c* is a front view of the alternative embodiment of a replaceable electrical contact in a compressed position.
Figure 4:
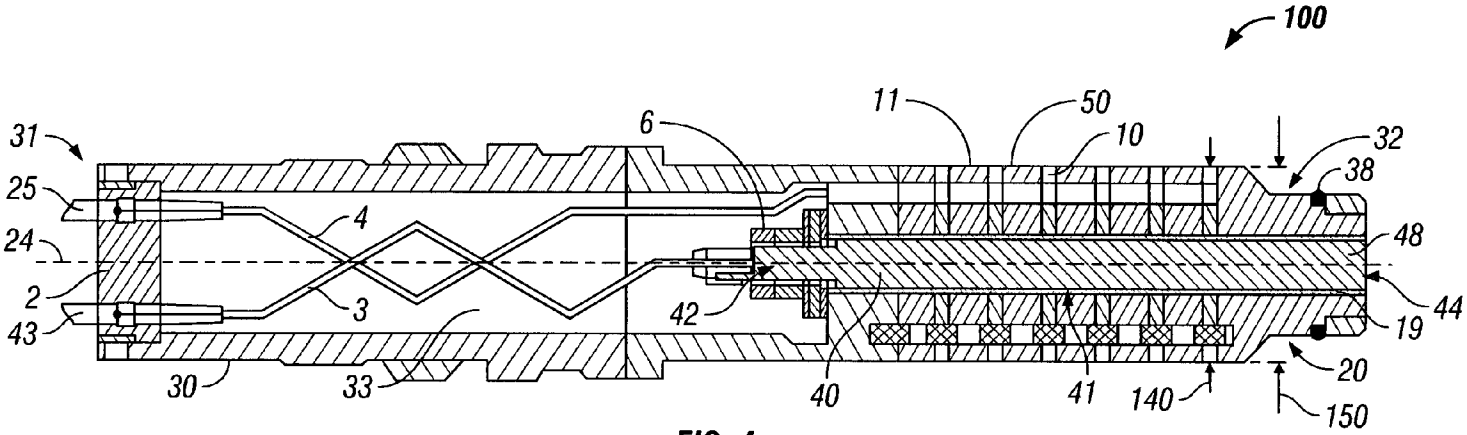
FIG. 4 is a cross sectional view of the first alternative embodiment of a probe of the rotary connector having replaceable electrical contacts, together with the alternative o-ring receiving location.
Figure 5:
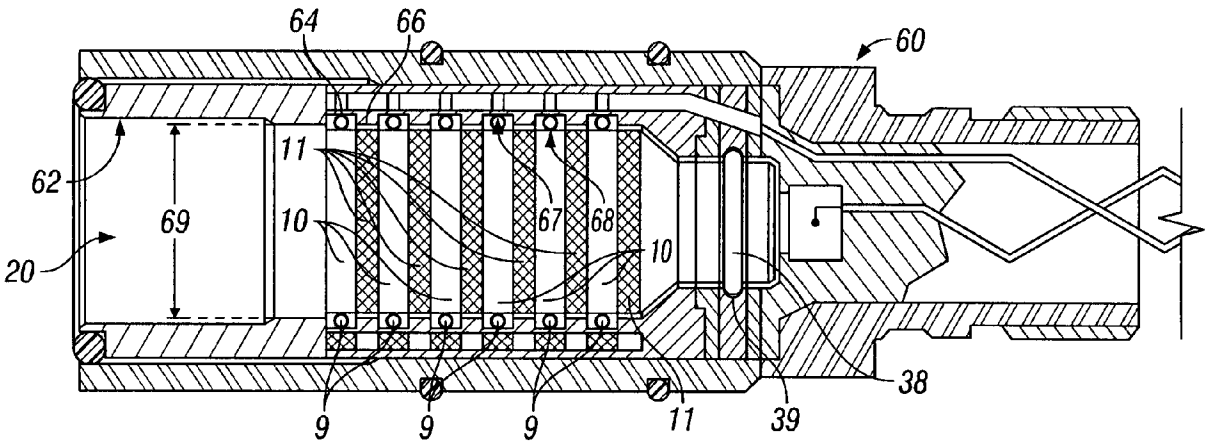
FIG. 5 is a cross sectional view of the first alternative embodiment of receiver of the rotary connector, having the probe therein, together with the alternative o-ring.

In an alternative embodiment, depicted in FIGS. 4 and 5, receiver 60 and probe 20 may be constructed in inverse fashion. Conductor rings 10 and insulator rings 11 have equal outer diameters 140 and 150, providing a flush surface to probe 20. Receiver 60 would have recessed conductor rings 64, wherein conductor ring inner surface 67 would be recessed compared to insulator ring inner surface 68, sufficiently recessed to accept removable contact 9. Further, replaceable contact 9 should be compressed, as depicted in FIG. 3*c*, thereby providing a suitable configuration for insertion into conductor rings 10. In operation such alternative embodiment requires use of additional tools to extract and replace removable contacts, unlike the preferred embodiment.

In a further alternative embodiment, depicted in FIGS. 1, 2, 4, and 5, probe 20 may have an O-ring 38 affixed about cylindrical body 30 designed to mate to a receiving location 39 within receiver 60 to provide a more rigid attachment between the two connectors and thereby retain the two connectors in relation to each other, even during relative rotation.

The foregoing description of the invention illustrates a preferred embodiment thereof. Various changes may be made in the details of the illustrated construction within the scope of the appended claims without departing from the true spirit of the invention. The present invention should only be limited by the claims and their equivalents.

What is claimed is:

1. An electrical connector comprising:

a) a probe having i) a body, ii) a connector rod, said connector rod retained by said body;

iii) an insulating sleeve, said insulating sleeve covering said connector rod;

said insulating sleeve retained by said body;

iv) at least one probe conductor ring, v) and at least two probe insulator rings;

A) said at least one probe conductor ring externally spaced along said insulating sleeve between said at least two probe insulator rings;

B) said at least one probe conductor ring having an outer diameter less than the outer diameter of said at least two probe insulator rings, a recess being formed above said at least one probe conductor ring bounded on each of two sides by one each of said at least two probe insulator rings;

vi) an elastic, electrically-conductive contact, said elastic, electrically-conductive contact having a near-relaxed position and an extended position, said elastic, electrically-conductive contact having a relaxed inner diameter and a relaxed outer diameter, said elastic, electrically-conductive contact having an extended inner diameter and an extended outer diameter, said elastic, electrically-conductive contact sufficiently expansive that said extended inner diameter of said elastic, electrically-conductive contact is greater than said outer diameter of said at least one insulator ring, said near-relaxed inner diameter of said elastic, electrically-conductive contact equivalent to said outer diameter of said at least one conductor ring, said near-relaxed outer diameter of said elastic, electrically-conductive contact greater than said outer diameter of said at least one insulator ring, said elastic, electrically-conductive contact having a spring force coefficient sufficiently low to permit said elastic, electrically-conductive contact to be selectively removeable from around said at least one conductor ring by expansion of said elastic, electrically-conductive contact to said extended position, b) a receiver i) said probe selectively receivable by said receiver;

ii) said receiver having

A) a housing,

B) at least one receiver conductor rings proximate to each of said at least one probe conductor rings, said receiver conductor ring spaced within said receiver housing to contact said elastic, electrically-conductive contact when said probe is selectively received by said receiver, C) and at least two receiver insulator rings, one of each of said number of receiver conductor rings spaced along said receiver housing between said at least two receiver insulator rings.

2. The conductor ring of claim 1, wherein said probe conductor ring is has a concave outer shape.

3. An electrical connector of the type having a probe and a receiver, said probe being selectively receivable within said receiver;

said probe having a body, a connector rod, said connector rod retained by said body, an insulating sleeve, said insulating sleeve covering said connector rod, said insulating sleeve retained by said body, said probe having at least one conductor ring, said at least one conductor ring having an outer diameter, said at least one conductor ring having a width, said probe having at least one insulator ring, said at least one conductor ring and said at least one insulator ring being alternatively located along said insulating sleeve, said at least one insulator ring having an outer diameter, said outer diameter of said at least one conductor ring being less than said outer diameter of said insulator ring, said receiver having a housing, said receiver having at least one conductor ring, said at least one conductor ring of said receiver being proximate said at least one conductor ring of said probe when said probe is selectively received within said receiver, said receiver having at least one insulator ring, said at least one insulator ring of said receiver being proximate said at least one insulator ring of said probe when said probe is selectively received within said receiver, comprising:

an elastic, electrically-conductive contact, said elastic, electrically-conductive contact having a near-relaxed position and an extended position, said elastic, electrically-conductive contact having a relaxed inner diameter and a relaxed outer diameter, said elastic, electrically-conductive contact having an extended inner diameter and an extended outer diameter, said elastic, electrically-conductive contact sufficiently expansive that said extended inner diameter of said elastic, electrically-conductive contact is greater than said outer diameter of said at least one insulator ring, said near-relaxed inner diameter of said elastic, electrically-conductive contact equivalent to said outer diameter of said at least one conductor ring, said near-relaxed outer diameter of said elastic, electrically-conductive contact greater than said outer diameter of said at least one insulator ring, said elastic, electrically-conductive contact selectively removeable from said at least one conductor ring.

4. The electrical connector of claim 3, wherein said probe conductor ring has an outer surface at said outer diameter, said outer surface being concave.

5. The electrical connector of claim 4, wherein said body of said probe is adapted to receive an o-ring and wherein said housing of said receiver has a mating location for receiving said o-ring.

6. The electrical connector of claim 3, wherein said body of said probe is adapted to receive an o-ring and wherein said housing of said receiver has a mating location for receiving said o-ring.

7. An electrical connector of the type having a probe and a receiver, said probe being selectively receivable within said receiver;

said receiver having a housing, said receiver having at least one conductor ring, said at least one conductor ring having an inner diameter, said at least one conductor ring having a width, said receiver having at least one insulator ring, said at least one conductor ring and said at least one insulator ring being alternatively located within said housing, said conductor ring having an inner surface, said at least one insulator ring having an inner surface, said inner surface of said at least one conductor ring being recessed in relation to said inner surface of said insulator ring, said probe having a body, a connector rod, said connector rod retained by said body, an insulating sleeve, said insulating sleeve covering said connector rod, said insulating sleeve retained by said body, said probe having at least one conductor ring, said at least one conductor ring of said probe being proximate said at least one conductor ring of said receiver when said probe is selectively received within said receiver, said probe having at least one insulator ring, said at least one insulator ring of said probe being proximate said at least one insulator ring of said receiver when said probe is selectively received within said receiver, comprising:

an elastic, electrically-conductive contact, said elastic, electrically-conductive contact having a relaxed position and a compressed position, said elastic, electrically-conductive contact having a relaxed inner diameter and a relaxed outer diameter, said elastic, electrically-conductive contact having a compressed inner diameter and a compressed outer diameter, said electrically-conductive contact sufficiently compressive that said compressed outer diameter is not greater than insulator ring inner surface, said relaxed outer diameter of said elastic, electrically-conductive contact contacting said inner surface of said at least one conductor ring of said receiver, said relaxed contact inner diameter of said elastic, electrically-conductive contact contacting said at least one conductor ring of said probe, said elastic, electrically-conductive contact selectively removeable from said at least one conductor ring of said receiver.

8. The electrical connector of claim 7, wherein said receiver conductor ring has an inner surface, said inner surface being concave.

9. The electrical connector of claim 8, wherein said body of said probe is adapted to receive an o-ring and wherein said housing of said receiver has a mating location for receiving said o-ring.

10. The electrical connector of claim 7, wherein said body of said probe is adapted to receive an o-ring and wherein said housing of said receiver has a mating location for receiving said o-ring.

* * * * *